United States Patent [19]

Goding et al.

[11] Patent Number: 4,628,824

[45] Date of Patent: Dec. 16, 1986

[54] SELF STEERING RAILWAY TRUCK

[75] Inventors: David J. Goding, Willow Springs; Mostafa Rassaian, Chicago, both of Ill.

[73] Assignee: General Motors Corporation, Detroit, Mich.

[21] Appl. No.: 705,330

[22] Filed: Feb. 25, 1985

[51] Int. Cl.[4] ..... B61F 05/38

[52] U.S. Cl. ..... 105/168; 105/175.1; 105/182.1

[58] Field of Search ..... 105/165, 167, 168, 172, 105/175 R, 176, 157 R, 182 R

[56] References Cited

U.S. PATENT DOCUMENTS

| | | | |
|---|---|---|---|
| 219,512 | 9/1879 | Peyton | 105/167 |
| 727,919 | 5/1903 | Ellery | 105/168 |
| 956,900 | 5/1910 | Knobbs | 105/168 |
| 3,528,374 | 9/1970 | Wickens | 105/182 |
| 3,789,770 | 2/1974 | List | 105/168 |
| 4,064,809 | 12/1977 | Mulcahy | 105/167 |
| 4,067,262 | 1/1978 | Scheffel | 105/168 |
| 4,075,950 | 2/1978 | Marta et al. | 105/197 A |
| 4,131,069 | 12/1978 | List | 105/168 |
| 4,134,343 | 1/1979 | Jackson | 105/167 |
| 4,136,620 | 1/1979 | Scheffel et al. | 105/168 |
| 4,151,801 | 5/1979 | Scheffel et al. | 105/168 |
| 4,167,906 | 9/1979 | Steinmann et al. | 105/168 |
| 4,170,179 | 10/1979 | Vogel | 105/168 |
| 4,237,791 | 12/1980 | Jackson et al. | 105/168 |
| 4,244,297 | 1/1981 | Monselle | 105/168 |
| 4,274,339 | 6/1981 | Cope | 105/168 |
| 4,285,280 | 8/1981 | Smith | 105/168 |
| 4,287,832 | 9/1981 | Kreissig et al. | 105/176 |
| 4,295,428 | 10/1981 | Dickhart, III et al. | 105/168 |
| 4,300,454 | 11/1981 | Scheffel | 105/168 |
| 4,332,201 | 6/1982 | Pollard et al. | 105/167 |
| 4,413,569 | 11/1983 | Mulcahy | 105/168 |
| 4,417,525 | 11/1983 | Levy | 105/166 |
| 4,428,301 | 1/1984 | Jackson | 105/168 |
| 4,429,637 | 2/1984 | Jackson et al. | 105/168 |
| 4,434,719 | 3/1984 | Mekosh, Jr. | 105/168 |
| 4,440,094 | 4/1984 | Levy | 105/166 |
| 4,455,946 | 6/1984 | List | 105/168 |
| 4,458,604 | 7/1984 | Cope | 105/168 |

FOREIGN PATENT DOCUMENTS

| | | | |
|---|---|---|---|
| 837711 | 3/1952 | Fed. Rep. of Germany | 105/165 |

OTHER PUBLICATIONS

"Progressive Railroading", Feb., 1982, Cross-Braced Truck Article, pp. 60 and 61.

*Primary Examiner*—Robert B. Reeves
*Assistant Examiner*—Dennis C. Rodgers
*Attorney, Agent, or Firm*—Robert J. Outland

[57] ABSTRACT

A self steering railway truck, especially a powered locomotive type, provides limited freedom for axle steering motion in the truck frame with a separate linkage of parallel rods and a steering beam for transmitting traction and braking forces to the truck frame. The linkages of two end axles are interconnected for equal and opposite motion to maintain stability and leave room for maintaining traction motors and brake equipment as well as separating effects from yaw and lateral axle motions.

19 Claims, 6 Drawing Figures

SELF STEERING RAILWAY TRUCK

TECHNICAL FIELD

This invention relates to self steering railway trucks of a type wherein the axles are allowed limited freedom to seek substantially radial positions in a curve. In preferred embodiments the invention relates to powered railway trucks for locomotives and the like, especially of the type wherein individual traction motors are supported between the frame and individual axles driven thereby.

BACKGROUND

Various types of steering railway trucks have been proposed wherein the angular position of the axles and their associated wheels are allowed or forced to adjust during curve negotiation to maintain more or less radial positions with respect to the curve. The purpose of such arrangements is, generally, to reduce friction and wear of wheels and rails by minimizing lateral creep forces. While most applications have been proposed for non-powered railway car, trucks, some locomotive applications have also been proposed.

Prior steering railway trucks have included some having soft primary suspensions which allow relatively free longitudinal and/or lateral motion of the wheel and axle assemblies within established limits. Some arrangements include inter-axle connections that require related motions among axles of the same truck. Some of the arrangements are such that lateral wheel and axle motion gives rise to forced yaw or steering, whereas other arrangements substantially isolate these functions. Both powered and unpowered axles have been arranged for steering; however, forced steering of powered axle vehicles relative to truck turning motion in relation to the carbody is common.

SUMMARY OF THE INVENTION

The present invention provides an improved arrangement for self steering railway trucks, and particularly for powered railway trucks such as in locomotives, in which equalized self steering of the axles is provided through a linkage including connected steering beams and traction rods. The mechanism is so arranged as to separate the effects of steering and lateral motions of the axles and is particularly adapted for powered truck applications where it extends around the sides and one end of the axle and frame supported traction motors.

While particularly adapted to the requirements of two axle motor powered road locomotive type railway trucks, the invention is also capable of use in unpowered trucks and in railway trucks having three or more axles where the extreme and axles are interconnected by linkage according to the invention.

In railway trucks according to the invention, traction or connecting rods extend longitudinally from journal boxes at the ends of each axle to a steering beam extending transversely and pivotally mounted at its center to the truck frame. The steering beams of the opposite end axles are preferably interconnected by a link or linkage to require equal and opposite oscillating motions of the steering beams during like steering motions of the axles. The steering beams and traction rods are preferably mounted near axle height to minimize the effect of traction forces on weight distribution.

The invention is applicable to various forms of railway trucks including powered and unpowered, having dual or other multiple axles, and with or without bolsters. However, for a further understanding of the features of the invention, reference will be had to an application of the invention in a two axle bolster type powered railway locomotive truck as illustrated in the following description and drawings in which:

BRIEF DRAWING DESCRIPTION

DETAILED DESCRIPTION

Figure 1:
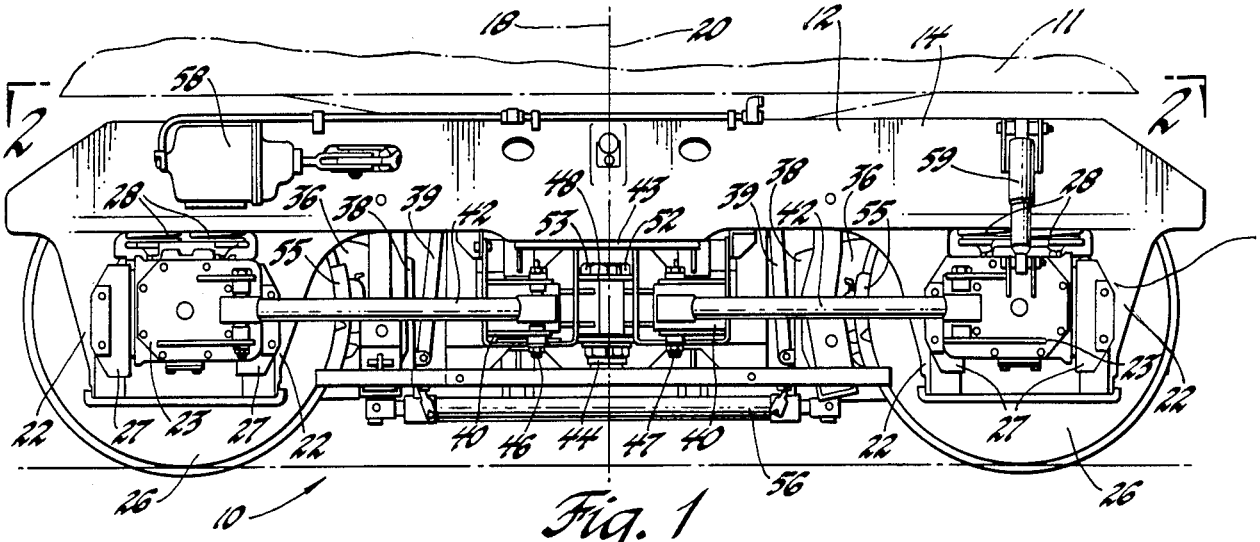
FIG. 1 is a side view of a two axle railway locomotive truck in accordance with the invention as installed under a locomotive carbody.
Figure 2:
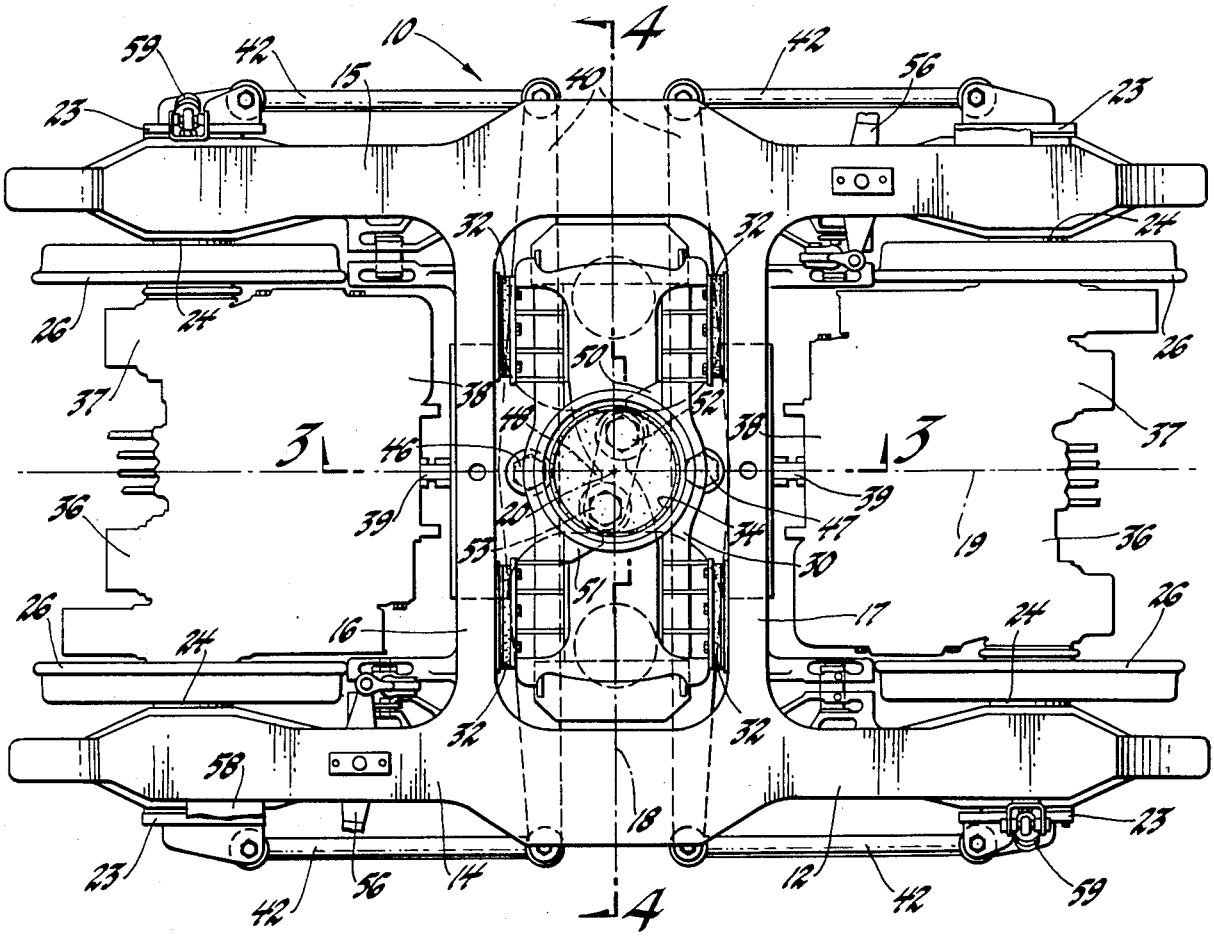
FIG. 2 is a top view of the truck from the plan indicated by line 2—2 of FIG. 1.
Figure 3:
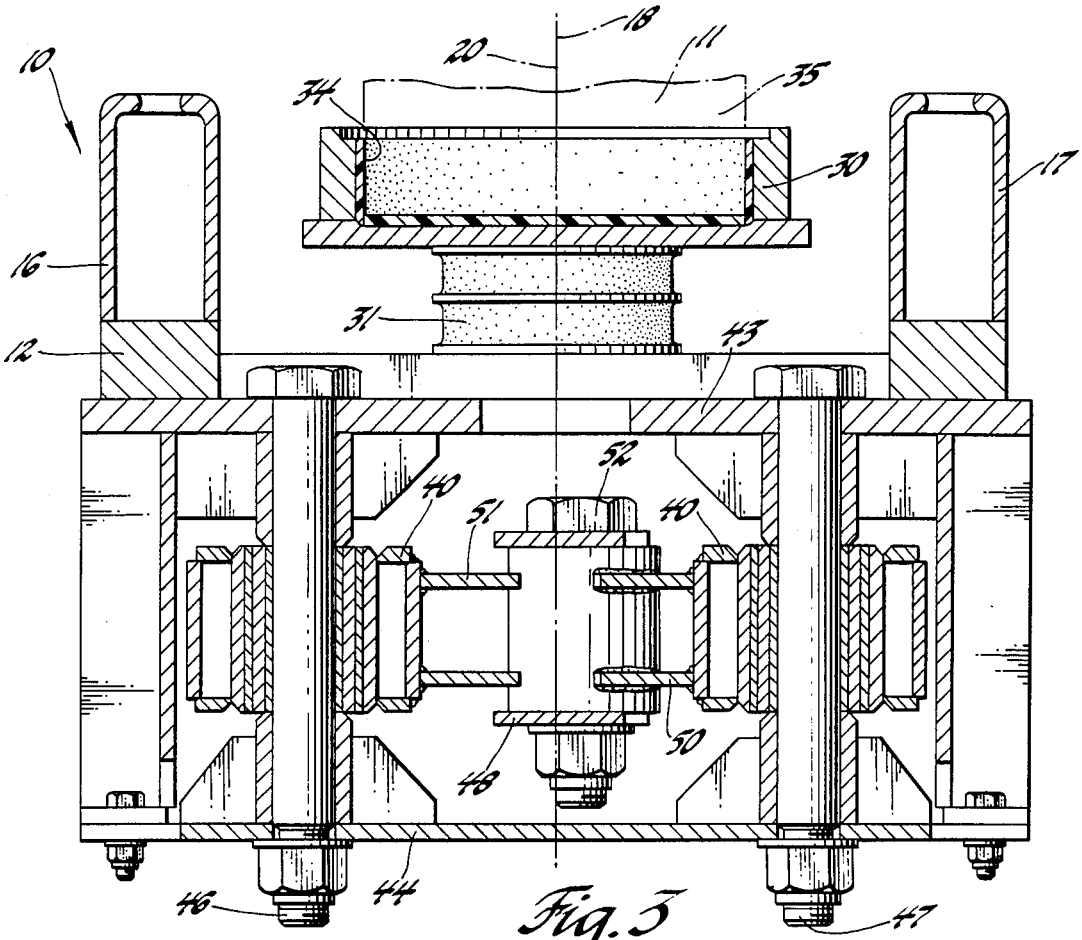
FIG. 3 is a longitudinal cross-sectional view through the central frame, linkage and bolster portions from the plane indicated by the line 3—3 of FIG. 2.
Figure 4:
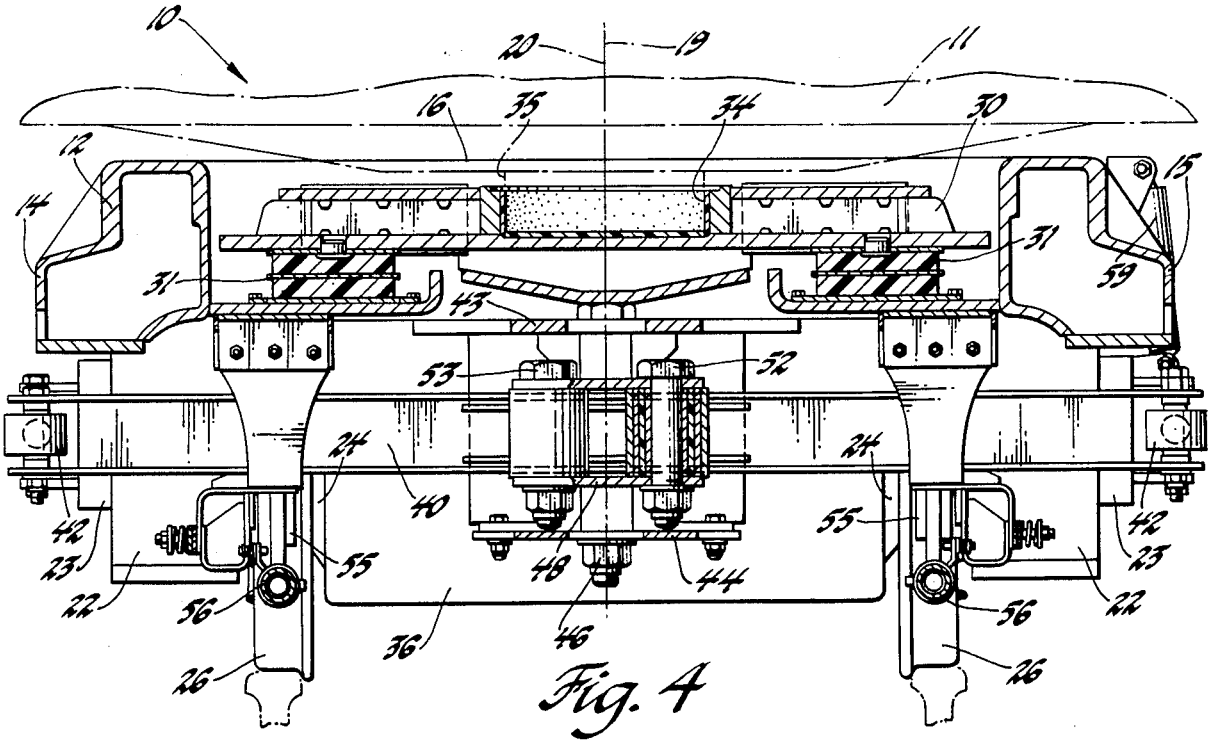
FIG. 4 is a transverse cross-sectional view from the plane indicated by the line 4—4 of FIG. 2.
Figure 5:
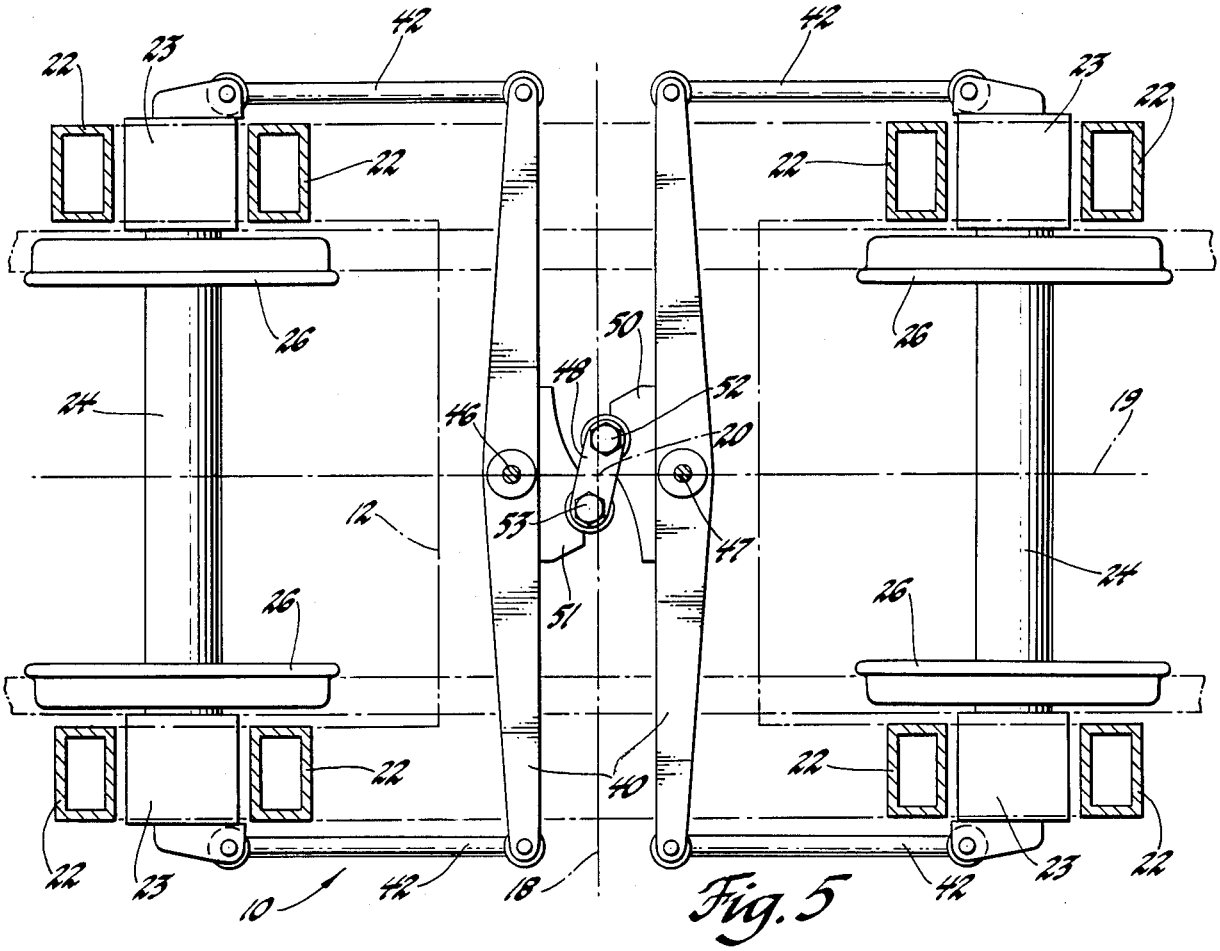
FIG. 5 is a diagrammatic view of the interconnected axles and steering linkage showing their operating positions on tangent track.
Figure 6:
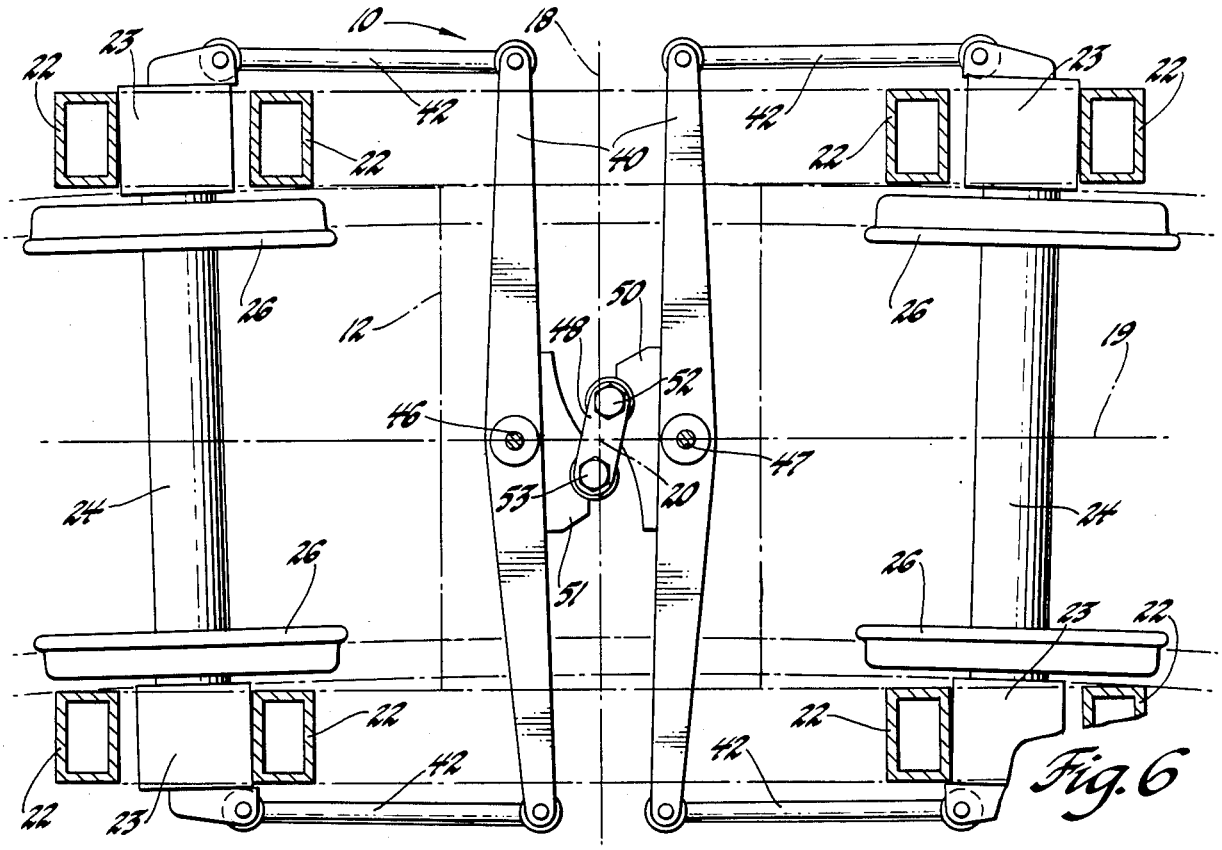
FIG. 6 is a diagrammatic view of the interconnected axles and steering linkage showing their operating positions on curved track.

In the drawings, numeral 10 generally indicates a powered self steering railway truck of the road locomotive type supporting one end of a locomotive carbody 11 shown in FIGS. 1, 3 and 4 by phantom lines. The truck 10 includes a unitary frame 12 which may be fabricated, cast or otherwise manufactured. The frame 12 includes a pair of generally parallel, laterally spaced, longitudinally extending side frames 14, 15 interconnected by a pair of transoms 16, 17, longitudinally spaced equidistant from a central transverse vertical plane 18. A central longitudinal vertical plane 19, located equidistant from the side frames 14, 15 intersects the transverse plane 18 in a central vertical axis 20.

Adjacent their ends, the truck side frames 14, 15 include downwardly extending pedestals 22 for receiving journal boxes 23 rotatably supported on the ends of axles 24 carried by rail engaging wheels 26. The wheels 26 are arranged in laterally spaced pairs connected by a single axle 24 to form longitudinally spaced wheel and axle assemblies. The journal boxes 23 are disposed in the pedestals between bearing surfaces formed by pedestal liners 27 or other suitable pedestal bearing surfaces. A small amount of longitudinal clearance is provided to allow for limited longitudinal motion of the journal boxes relative to the truck frame for steering of the wheel and axle assemblies in a manner to be subsequently described.

Lateral stops, not shown, are provided between the journal boxes and the truck frame to limit lateral motion of the wheel and axle assemblies to a predetermined amount. The truck frame is supported on the journal boxes by a relatively soft primary suspension comprising coil springs 28 for which rubber or other suitable alternative resilient suspension means or devices could be substituted.

Centrally of the truck, a transverse bolster 30 is carried within a space bounded by the side frames 14, 15 and transoms 16, 17. The bolster is supported upon the truck frame by a relatively stiff secondary suspension comprising, but not limited to, rubber sandwich elements 31. Front and rear bearing plates 32 are provided between the bolster and transoms which substantially limit movement of the bolster to lateral and vertical motions relative to the truck frame and transfer longitudinal traction and braking forces between the bolster and truck frame. A center bearing 34 is provided at the center of the bolster for pivotally connecting the truck with a downward projection 35 of the carbody.

For powering the wheel and axle assemblies to drive the locomotive, the truck is provided with a pair of traction motors 36. Each motor has an outer end 37 supported by conventional bearing means on one of the axles 24, and an inner end 38 carried from the adjacent transoms 16, 17 by a depending link 39. The link is flexibly or swivelly connected at its ends to allow a limited amount of both longitudinal and lateral motion between the inner end of the traction motor and the adjacent transom member from which it is supported.

To provide for limited self-steering action of the wheel and axle assemblies in accordance with the invention, while transmitting traction and braking forces between the wheel and axle assemblies and the truck frame, the truck is provided with suitable traction linkage. This linkage includes a pair of lateral steering beams 40 pivotally connected at their centers with the truck frame and each connected at their ends with the journal boxes of one of the wheel and axle assemblies by connecting rods, or traction rods, 42. The traction rod connections are preferably by means of rubber bushings, spherical connections or other movable joints to permit relative vertical motion between the steering beams and their connected journal boxes.

The central pivotal mounting of the steering beams 40 is provided by upper and lower support plates 43, 44 of a support structure carried below the transoms 16, 17 of the truck frame and carrying pivot pins 46, 47 on which the front and rear steering beams 40 are respectively pivotally carried. The pivot pins 46, 47 are vertically disposed along the central longitudinal plane 19 of the truck and spaced equidistant from the vertical central axis 20, just inwardly of the transoms 16, 17.

The steering beams 40 are, in turn, interconnected for substantially equal and opposite pivotal motions. For this purpose, a link 48, connects laterally offset forward and rearward extensions 50, 51 of the rear and front steering beams 40, respectively, through pin and bushing connections 52, 53.

Braking action for the truck may be provided for in any suitable manner. The illustrated embodiment includes more or less conventional brake rigging, including wheel engaging brake shoes 55 carried by conventional frame supported brake rigging 56 actuated by truck frame supported air brake cylinders 58. If desired, vertical motions of the truck frame with respect to the wheel and axle assemblies may be damped in conventional manner by friction or hydraulic damping devices 59 connected between the truck frame and one or more of the axle carried journal boxes 23.

For the purposes of carrying out the invention, the traction linkage comprising the steering beams and connecting rods are preferably disposed near axle height. The traction rods extend forward in the parallel, generally horizontal orientation from the journal boxes at the ends of the axles toward the central plane 18 of the truck. There they connect with the steering beams to define a linkage passing essentially around three sides of the traction motors, so as to avoid extending through or otherwise impinging upon the space provided for the traction motors and the brake linkage adjacent the truck wheels. Also, if desired, the wheel treads may be formed with a higher than normal taper to encourage self-steering action, although this is not necessarily a requirement of the present design, which permits self-steering action to occur even with the normal wheel tread taper conventionally provided for locomotive trucks.

In operation, normal pivotal action of the truck with respect to the railway carbody is provided by the center bearing connection between the truck and carbody. Such action could alternatively be provided by bolsterless suspension means or other support means known in the art. Also in known manner, the clearance provided between the pedestals 22 and their associated journal boxes 23 permits relative longitudinal motion of the axles within the truck frame so as to allow self-steering of the wheel and axle assemblies within the truck frame. Such action is known in the art to allow the axle members of conventionally or more highly tapered wheel and axle assemblies, of the flanged rail engaging type herein considered, to seek more or less radial positions during curving action of a railway vehicle.

Such self-steering action of the wheel and axle assemblies is known to reduce friction and wear between the wheels and rails and, in powered trucks, has been found to provide more efficient application of tractive effort and to reduce traction-limiting wheel slippage during curving action. However, unrestrained self-steering action of the axles may have the effect of reducing stability of a railway truck in an unacceptable degree. This is avoided in the present instance by the interconnection, through the nearly transverse link 48, of the steering beams 40, which limits the pivotal motion of the steering beams to substantially equal and opposite oscillating motion. This, in turn, limits the turning motions of the connected wheel and axle assemblies to like equal and opposite oscillating motions so that self-steering action is allowed, but only to the extent that the turning motions of the axles are in equal and opposite amounts, all within the limits provided by clearances between the truck pedestals and journal boxes.

Traction and braking forces are also carried from the wheel and axle assemblies to the truck frame through the traction linkage consisting of the traction links 42 and the steering beams 40. Thus, all traction and braking loads are carried through the pivot pins 46, 47 to the truck frame and from the truck frame through the bearing plates 32 to the bolster 30 where they pass through the center bearing 34 to the carbody 11.

Because of the parallel and longitudinal orientation of the traction rods, the application of traction and braking forces does not create any side thrust forces on the wheel and axle assemblies. Also, lateral motion of the axles relative to the truck frame, allowed within desired limits to accommodate track variations and other side thrust loads, do not introduce any yaw, or steering, component of force into the system, as is the case with diagonally interconnected axles commonly provided. Thus, with the present invention complete separation of yaw and lateral motions of the truck axles is maintained.

While the invention has been disclosed by reference to a particular embodiment chosen for purposes of illustration, it should be understood that the self-steering and other features of the present invention and the forms of trucks to which they are applied could be modified without departing from the spirit and scope of the novel concepts described. Accordingly, it is intended that the invention not be limited to the described embodiment, but that it have the full scope permitted by the language of the following claims.

The embodiments of the invention in which an exclusive property or privilege is claimed are defined as follows:

1. A combination in a self steering railway truck of a pair of longitudinally spaced rail engaging wheel and axle members each including a pair of wheels laterally connected by an axle, a frame having a central longitudinal and vertical plane and carried near opposite ends by said axles, yieldable retaining and suspension means supporting the frame on the axles and nominally urging said wheel and axle members into centered positions for motion along straight paths aligned with said central plane but permitting limited self-induced yawing of said members during movement along curved paths, and force transmitting linkages, one connecting each of said wheel and axle members with said frame, each said linkage including a lateral steering beam and a pair of parallel connecting rods, each said steering beam having a center pivotally connected with said frame in said central plane and being free of any connection with an associated carbody except through said frame, and said connecting rods nominally extending in planes parallel with said central plane and pivotally connecting points on the steering beams laterally opposite and equidistant from their centers with points of the wheel and axle members longitudinally aligned with their connected steering beam points to carry longitudinal forces from the wheels to the truck frame without causing significant yaw forces in the wheel and axle members.

2. A combination as in claim 1 wherein said wheels are fixed to and rotatable only with their respective axles and said force transmitting linkages are interconnected to require self steering yaw motions of said wheel and axle members to be of opposite sense and equal extent.

3. A combination as in claim 2 wherein said steering beams are located near axle height and the connecting rods lie at least close to horizontal positions.

4. A combination as in claim 2 wherein the truck frame is carried primarily above the axles and the steering beams are located below a central portion of the frame near the level of the axles, the traction rods lying at least close to horizontal positions.

5. A combination as in claim 2 wherein the steering beams are connected with the truck frame at adjacent locations near a point between and equidistant from the axles.

6. A combination as in claim 5 wherein said truck has only two wheel and axle members.

7. A combination in a powered self steering railway truck of a pair of longitudinally spaced rail engaging wheel and axle members each including a pair of wheels laterally connected by an axle, a frame having a central longitudinal and vertical plane and carried near opposite ends by said axles, yieldable retaining and suspension means supporting the frame on the axles and nominally urging said wheel and axle members into centered positions for motion along straight paths aligned with said central plane but permitting limited self-induced yawing of said members during movement along curved paths, power means for driving said wheels, and traction linkages, one connecting each of said wheel and axle members with said frame, each said traction linkage including a lateral steering beam and a pair of parallel traction rods, each said steering beam having a center pivotally connected with said frame in said central plane and being free of any connection with an associated carbody except through said frame, and said traction rods nominally extending in planes parallel with said central plane and pivotally connecting points on the steering beams laterally opposite and equidistant from their centers with points of the wheel and axle members longitudinally aligned with their connected steering beam points to carry traction forces from the wheels to the truck frame without transmitting significant traction related yaw forces to the wheel and axle members.

8. A combination as in claim 7 wherein said wheels are fixed to and rotatable only with their respective axles.

9. A combination as in claim 8 wherein said power means include a traction motor drivingly connected with each axle and each traction linkage extends partially around the traction motor for its respective axle.

10. A combination as in claim 9 wherein the steering beams are located near axle height and the traction rods lie in essentially horizontal positions.

11. A combination in a powered self steering railway truck of a pair of longitudinally spaced rail engaging wheel and axle members each including a pair of wheels laterally connected by an axle, a frame having a central longitudinal and vertical plane and carried near opposite ends by said axles, yieldable retaining and suspension means supporting the frame on the axles and nominally urging said wheel and axle members into centered positions for motion along straight paths aligned with said central plane but permitting limited self-induced yawing of said members during movement along curved paths, power means for driving said wheel, traction linkages, one connecting each of said wheel and axle members with said frame, each said traction linkage including a lateral steering beam and a pair of parallel traction rods, each said steering beam having a center pivotally connected with said frame in said central plane and being free of any connection with an associated carbody except through said frame, said traction rods nominally extending parallel with said central plane and pivotally connecting points on the steering beam laterally opposite and equidistant from their centers with points of the wheel and axle members longitudinally aligned with their connected steering beam points to carry traction forces from the wheels to the truck frame without transmitting significant traction related yaw forces to the wheel and axle members, and means interconnecting said traction linkages to require self steering yaw motions of said wheel and axle members to be of opposite sense and equal extent.

12. A combination as in claim 11 wherein said interconnecting means are connected between said steering beams.

13. A combination as in claim 12 wherein the steering beams are connected with the truck frame at adjacent locations near a point between and equidistant from the axles and said interconnecting means include a link connected with both said steering beams.

14. A combination as in claim 13 wherein said wheels are fixed to and rotatable only with their respective axles, said power means include a traction motor drivingly connected with each axle, and each traction linkage extends partially around the traction motor for its respective axle.

15. A combination as in claim 14 wherein the steering beam and traction rods are located near axle height and lie in essentially horizontal positions.

16. A combination in a self steering railway truck of a pair of longitudinally spaced rail engaging wheel and axle members each including a pair of wheels laterally connected by an axle, a frame having a central longitudinal and vertical plane and carried near opposite ends by said axles, yieldable retaining and suspension means supporting the frame on the axles and nominally urging said wheel and axle members into centered positions for motion along straight paths aligned with said central plane but permitting limited self-induced yawing of said members during movement along curved paths, and force transmitting linkage connecting said wheel and axle members with said frame, said linkage including a lateral steering beam and a pair of connecting rods, said steering beam having a center pivotally connected with said frame in said central plane and being free of any connection with an associated carbody except through said frame, and said connecting rods nominally extending longitudinally on opposite sides of said central plane and pivotally connecting points on the steering beam laterally substantially opposite and equidistant from its center with points of one of the wheel and axle members longitudinally spaced from their connected steering beam points to carry longitudinal forces from the wheels to the truck frame without causing significant yaw forces in said one of the wheel and axle members.

17. A combination as in claim 16 wherein said wheels are fixed to and rotatable only with their respective axles and said force transmitting linkage includes means interconnecting said steering beam with the other of said wheel and axle members to require self steering yaw motions of said wheel and axle members to be of opposite sense and substantially equal extent.

18. A combination in a powered self steering railway truck of a pair of longitudinally spaced rail engaging wheel and axle members each including a pair of wheels laterally connected by an axle, a frame having a central longitudinal and vertical plane and carried near opposite ends by said axles, yieldable retaining and suspension means supporting the frame on the axles and nominally urging said wheel and axle members into centered positions for motion along straight paths aligned with said central plane but permitting limited self-induced yawing of said members during movement along curved paths, power means for driving said wheels, and traction linkage connecting said wheel and axle members with said frame, said traction linkage including a lateral steering beam and a pair of traction rods, said steering beam having a center pivotally connected with said frame in said central plane and being free of any connection with an associated carbody except through said frame, and said traction rods nominally extending longitudinally on opposite sides of said central plane and pivotally connecting points on the steering beam laterally opposite and equidistant from its center with points of one of the wheel and axle members longitudinally spaced from their connected steering beam points to carry traction forces from the wheels to the truck frame without transmitting significant traction related yaw forces to said one of the wheel and axle members.

19. A combination as in claim 18 wherein said wheels are fixed to and rotatable only with their respective axles and said traction linkage includes means interconnecting said steering beam with the other of said wheel and axle members to require self steering yaw motions of said wheel and axle members to be of opposite sense and substantially equal extent.

* * * * *